US008333635B2

(12) United States Patent
Su

(10) Patent No.: US 8,333,635 B2
(45) Date of Patent: Dec. 18, 2012

(54) SIMULATED EYE

(75) Inventor: Xiao-Guang Su, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 546 days.

(21) Appl. No.: 12/558,596

(22) Filed: Sep. 14, 2009

(65) Prior Publication Data

US 2010/0105281 A1 Apr. 29, 2010

(30) Foreign Application Priority Data

Oct. 29, 2008 (CN) ..... 2008 1 0305267

(51) Int. Cl.
*A63H 3/38* (2006.01)

(52) U.S. Cl. ..... 446/392; 446/389

(58) Field of Classification Search ..... 446/389, 446/392, 343
See application file for complete search history.

(56) References Cited

U.S. PATENT DOCUMENTS

| | | | | |
|---|---|---|---|---|
| 3,905,130 | A * | 9/1975 | Gordon et al. | 434/271 |
| 4,683,669 | A * | 8/1987 | Greer, Jr. | 40/414 |
| 5,900,923 | A * | 5/1999 | Prendergast et al. | 351/221 |
| 6,391,057 | B1 * | 5/2002 | Schleipman et al. | 623/6.64 |
| 6,586,859 | B2 * | 7/2003 | Kornbluh et al. | 310/309 |
| 7,485,025 | B2 * | 2/2009 | Schnuckle | 446/392 |
| 7,988,523 | B2 * | 8/2011 | Chang et al. | 446/392 |
| 7,993,181 | B2 * | 8/2011 | Lee et al. | 446/392 |
| 8,202,138 | B2 * | 6/2012 | Lai | 446/392 |
| 2001/0036790 | A1 * | 11/2001 | Kornbluh et al. | 446/337 |

FOREIGN PATENT DOCUMENTS

GB 1392431 A * 4/1975

* cited by examiner

*Primary Examiner* — Gene Kim
*Assistant Examiner* — Alyssa Hylinski
(74) *Attorney, Agent, or Firm* — Altis Law Group, Inc.

(57) ABSTRACT

A simulated eye includes a spherical cap eyeball, a resilient film, a driving mechanism, and a transmission mechanism. The eyeball includes a plurality of guide arms on an inner surface thereof. The resilient film received in the eyeball includes a pupil portion and an iris portion surrounding the pupil portion. The driving mechanism provides a first driving force and a second force opposite to the first driving force in direction. The transmission mechanism arranged between the driving mechanism and the resilient film includes a plurality of transmission members received and movable in the corresponding guide arms.

16 Claims, 4 Drawing Sheets

SIMULATED EYE

BACKGROUND

1. Technical Field

The present disclosure relates to replicas of human organs, and particularly to a replica of an eye.

2. Description of Related Art

A typical replica of a human eye allow such simulations as the eyelid opening and closing. Accordingly, other simulation effects are needed to make the eyes more lifelike.

Therefore, what is needed is a simulated eye capable of replicating human eye behavior.

DETAILED DESCRIPTION

Figure 1:
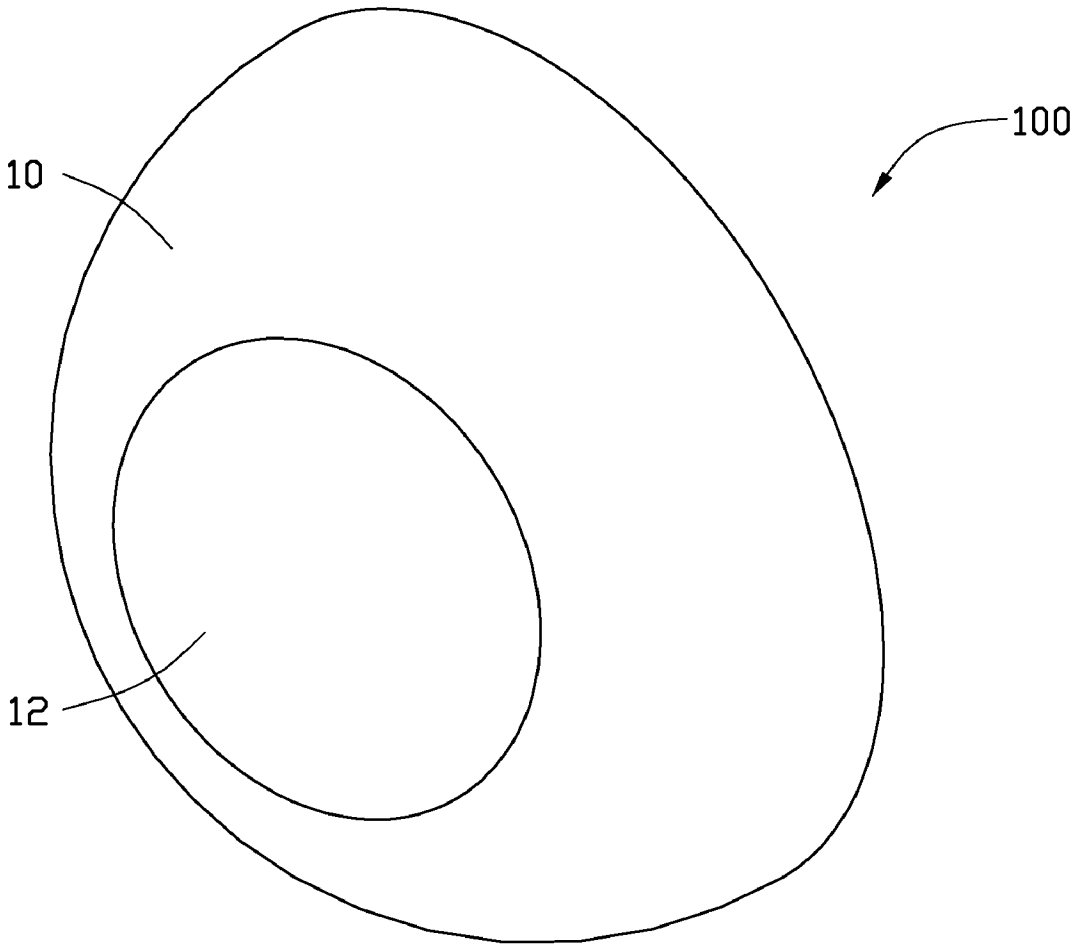
FIG. 1 is an isometric view of a simulated eye in accordance with an exemplary embodiment.
Figure 2:
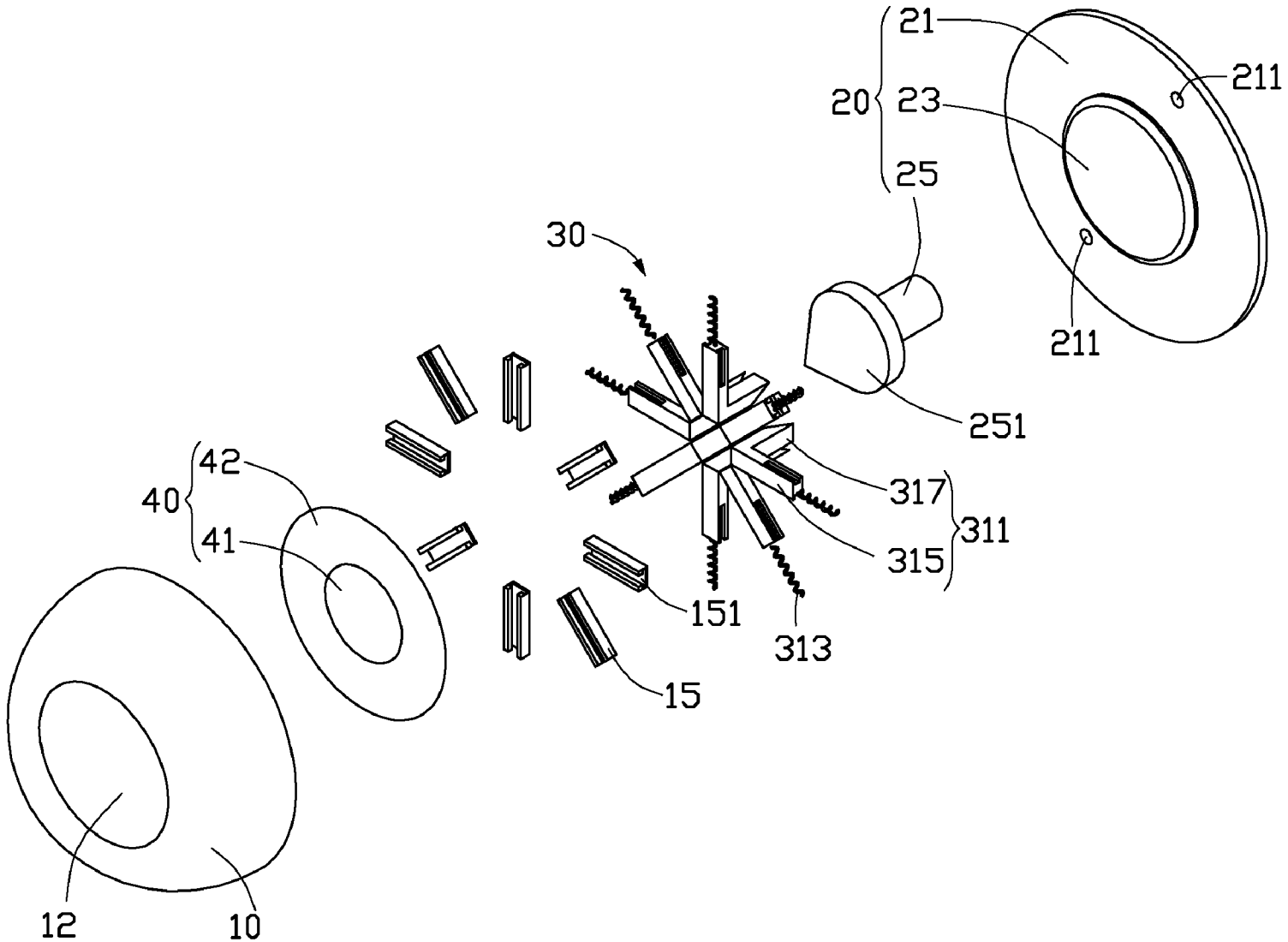
FIG. 2 is an exploded view of the simulated eye in FIG. 1.

Referring to FIGS. 1 and 2, a simulated eye 100 includes a spherical cap eyeball 10, a driving mechanism 20 fixed on back of the spherical cap eyeball 10, a circular resilient film 40 received in the eyeball 10, and a transmission mechanism 30 disposed between the driving mechanism 20 and the resilient film 40.

Figure 3:
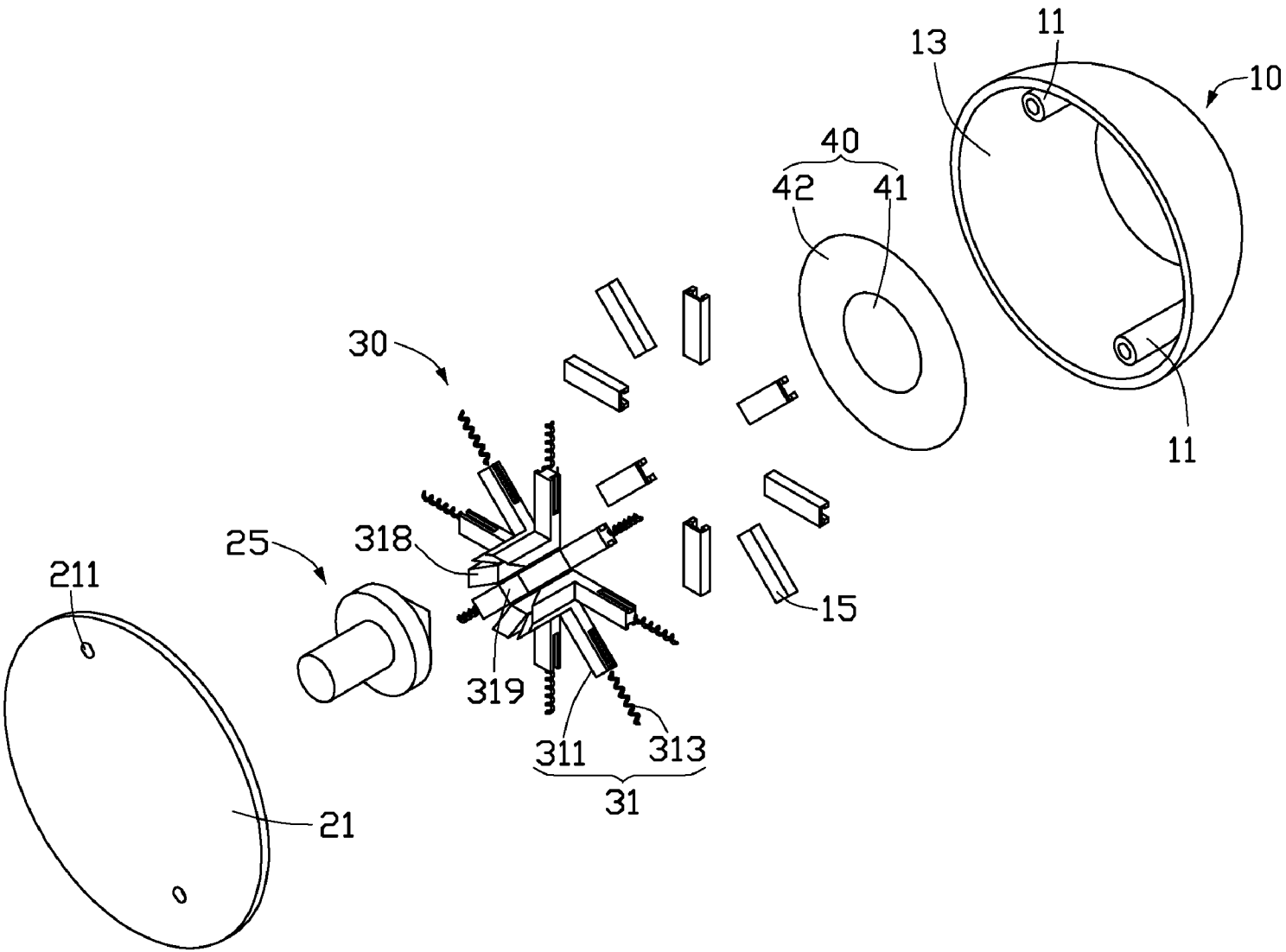
FIG. 3 is an exploded view of the simulated eye of FIG. 2 but viewed from a reverse direction to FIG. 2.
Figure 4:
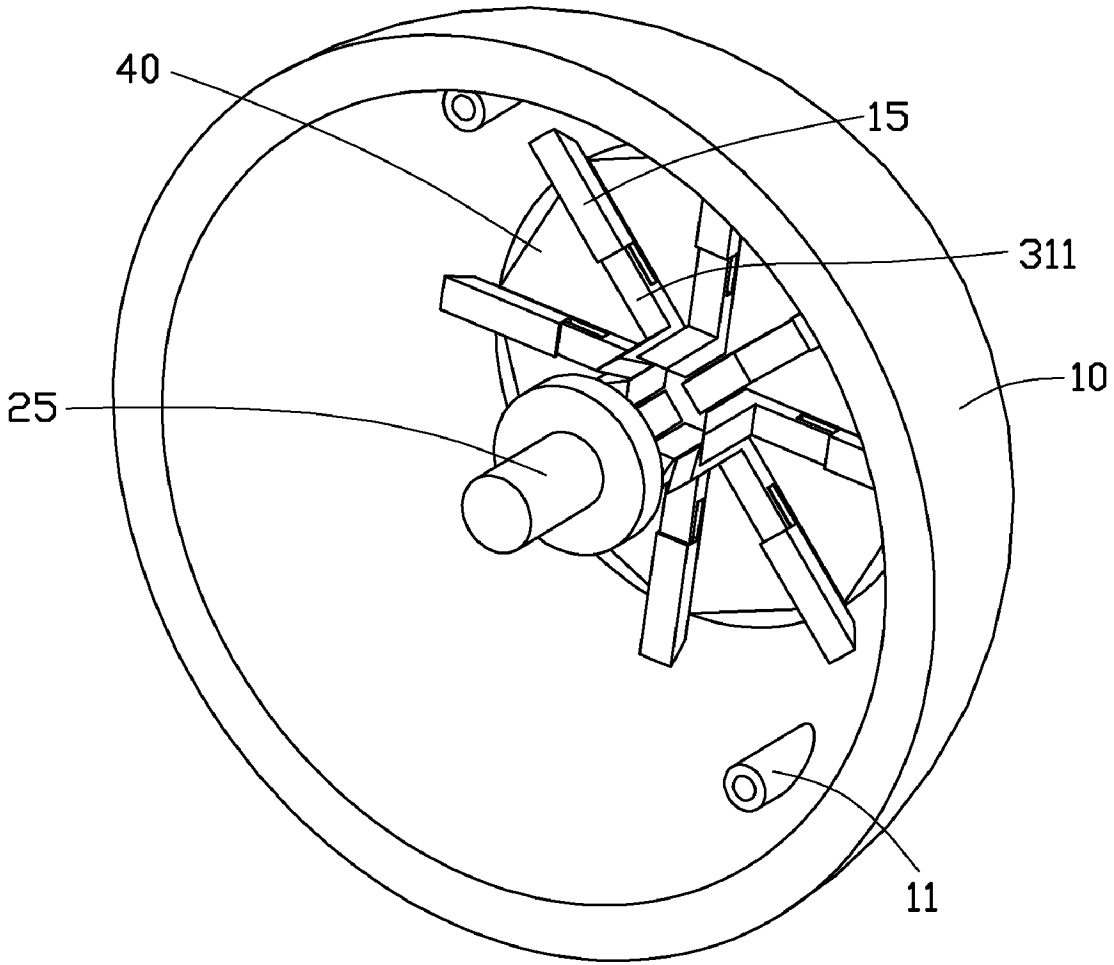
FIG. 4 is a partially isometric view of the simulated eye of FIG. 1 but viewed from a reverse direction to FIG. 1.

Referring to FIGS. 2-4, the eyeball 10 has a circular transparent area 12 capable of transmitting light. The transparent area 12 is arranged on the front of the eyeball 10. In another embodiment, the eyeball 10 may define an opening in the front of the eyeball 10 instead of the transparent area 12. The eyeball 10 further includes two fixing posts 11 and a plurality of rectangular guide arms 15. The fixing posts 11 may be threaded posts protruding from an inner surface 13 of the eyeball 10. The guide arms 15 are arranged in a radial manner, and one end of each guide arm 15 is fixed on the inner surface 13. Each guide arm 15 defines a rectangular guide slot 151 facing the transparent area 12.

The driving mechanism 20 includes a circular baseboard 21, an electromagnet 23, and a magnetic body 25 corresponding to the electromagnet 23. The baseboard 21 defines two fixing holes 211. Two fasteners (such as screws, not shown) engage the two fixing posts 11 after passing through the two fixing holes 211 correspondingly to fasten the baseboard 21 to the eyeball 10. The electromagnet 23 is mounted on one side of the baseboard 21 facing the eyeball 10, and the electromagnet 23 is disposed between the two fixing holes 211. The magnetic body 25 has a portion 251 tapered away from the electromagnet 23.

The resilient film 40 includes a circular pupil portion 41 and an annular iris portion 42 surrounding the pupil portion 41. The pupil portion 41 is in a first color. The iris portion 42 is in a second color other than the first color.

The transmission mechanism 30 includes a plurality of transmission members 31. The transmission members 31 are also arranged in a radial manner and partially received in the corresponding guiding slots 151. Each transmission member 31 includes a transmission component 311 and an elastic component 315.

Each transmission component 311 includes a first portion 315 partially received in the guide slot 151 and a second portion 317 substantially perpendicular to the first portion 315. The first portions 315 are in radial arrangement. The second portions 317 are parallel and disposed between the first portion 315 and the magnetic body 25. Each second portion 317 has an inclined surface 318 away from the first portion 315. The inclined surfaces 318 combine to form a tapered opening 319 receiving the tapered portion 251 of the magnetic body 25.

Each elastic component 313 may be a spring received in the corresponding guide slot 151. Opposite ends of the elastic component 313 are connected to one end of the first portion 315 away from the second portion 317 and an outside edge of the iris portion 42 respectively.

In use, the electromagnet 23 is electrified to generate a repellant force between the electromagnet 23 and the magnetic body 25, and the tapered portion 251 of the magnetic body 25 linearly enters the opening 319, and moves the transmission components 311 radially away from their original positions via the repellant force. The elastic components 313 move and stretch the resilient film 40 from an original size, such that dilation of the pupil portion 41 is replicated. At the same time, the elastic components 313 are compressed to generate restoring force.

When the electromagnet 23 is electrified to generate an attractive force between the electromagnet 23 and the magnetic body 25, the tapered portion 251 of the magnetic body 25 linearly withdraws from the opening 319 via the attractive force. The elastic components 313 return the transmission components 311 to their corresponding original positions via the restoring force. Thus, the pupil portion 41 is restored to the original size so contraction of the pupil portion 41 is replicated.

It is to be understood, however, that even though information and advantages of the present embodiments have been set forth in the foregoing description, together with details of the structures and functions of the present embodiments, the disclosure is illustrative only; and that changes may be made in detail, especially in matters of shape, size, and arrangement of parts within the principles of the present embodiments to the full extent indicated by the broad general meaning of the terms in which the appended claims are expressed.

What is claimed is:

1. A simulated eye, the simulated eye comprising:

an eyeball in a spherical cap shape with a plurality of guide arms on an inner surface thereof ;

a resilient film received in the eyeball, the resilient film comprising a pupil portion and an iris portion surrounding the pupil portion, the pupil portion being a first color, the iris portion being a second color other than the first color;

a driving mechanism providing a first driving force and a second force opposite to the first driving force in direction; and a transmission mechanism arranged between the driving mechanism and the resilient film, the transmission mechanism comprising a plurality of transmission members, each transmission member being movably received in a corresponding guide arm, wherein one end of each of the transmission members is connected to an outside edge of the resilient film, a residual end of each of the transmission members combine to form an opening suited to the driving mechanism;

wherein when the first driving force is generated, the driving mechanism enters the opening, moves the transmission members in the corresponding guide arms to stretch the resilient film, such that the pupil portion is dilated; and when the second driving force is generated, the driving mechanism withdraws from the opening, moves the transmission members in the corresponding guide arms to contract the resilient film, such that the pupil portion is contracted.

2. The simulated eye according to claim 1, wherein the driving mechanism comprises an electromagnet and a magnetic body arranged between the electromagnet and the transmission mechanism, the first driving force is a repellant force generated between the electromagnet and the magnetic body; and the second driving force is an attractive force generated between the electromagnet and the magnetic body.

3. The simulated eye according to claim 2, wherein the magnetic body comprises a tapered portion for moving the transmission members in the guide arms away from the electromagnet.

4. The simulated eye according to claim 2, wherein the driving mechanism further comprises a baseboard fastened to the eyeball, on which the electromagnet is mounted.

5. The simulated eye according to claim 1, wherein each transmission member comprises a transmission component and an elastic component connected between the transmission component and the resilient film; wherein when the first driving force is generated, the driving mechanism moves the transmission component and the elastic component of each transmission member in a corresponding guide arm, and at the same time, the elastic component of each transmission member is compressed to generate restoring forces; and when the second driving force is generated, the elastic component of each transmission member releases the restoring forces to move the transmission component of each transmission member in the corresponding guide arm.

6. The simulated eye according to claim 5, wherein each transmission component comprises a first portion connected to the elastic component and a second portion perpendicular to the first portion, with the second portion disposed between the driving mechanism and the first portion.

7. The simulated eye according to claim 6, wherein each second portion has an inclined surface away from the first portion, and the inclined surfaces combine to form the opening, which is tapered.

8. The simulated eye according to claim 2, wherein the guide arms and the transmission members are in a radial arrangement.

9. The simulated eye according to claim 2, wherein each guide arm defines a slot for receiving a corresponding transmission member.

10. A simulated eye, the simulated eye comprising:

an eyeball in a spherical cap shape with a plurality of guide arms in a radial arrangement;

a resilient film received in the eyeball with a pupil portion and an iris portion surrounding the pupil portion, the pupil portion being a first color, the iris portion being a second color other than the first color;

a driving mechanism comprising an electromagnet and a magnetic body; and a transmission mechanism arranged between the resilient film and the magnetic body, the transmission mechanism comprising a plurality of transmission members; the transmission members in a radial arrangement and corresponding to the guide arms; each transmission member being movably received in the corresponding guide arm, and wherein one end of each of the transmission members is connected to an outside edge of the resilient film;

wherein the magnetic body connects with the other end of each of the transmission members and moves the transmission members in the corresponding guide arms when a repellant force is generated between the electromagnet and the magnetic body, such that an area of the pupil portion in the first color is increased to replicate dilation of the simulated eye.

11. The simulated eye according to claim 10, the driving mechanism further comprising a baseboard fastened to the eyeball, on which the electromagnet is fastened.

12. The simulated eye according to claim 10, wherein each transmission member comprises a transmission component and an elastic component connected between the transmission component and the outside edge of the resilient film; wherein when the repellant force is generated between the electromagnet and the magnetic body, the magnetic body moves in and between the transmission components and moves the transmission components and the elastic components in the guide arms, and at the same time, the elastic components are compressed to generate restoring forces; wherein when an attractive force is generated between the electromagnet and the magnetic body, the elastic components move the transmission component out of the guide arms via the restoring forces.

13. The simulated eye according to claim 10, wherein the magnetic body comprises a tapered portion at an end thereof away from the electromagnet, and each transmission member comprises an inclined surface, and wherein the inclined surfaces combine to form a tapered opening corresponding to the tapered portion of the magnetic body.

14. The simulated eye according to claim 12, wherein each transmission component comprises a first portion connected to the elastic component and a second portion perpendicular to the first portion, and the second portion is disposed between the magnetic body and the first portion.

15. The simulated eye according to claim 14, wherein the magnetic body comprises a tapered portion at an end thereof away from the electromagnet, each second portion has an inclined surface away from the first portion, and the inclined surfaces combine to form a tapered opening corresponding to the tapered portion.

16. A simulated eye, the simulated eye comprising:

an eyeball in a spherical cap shape with a plurality of guide arms on an inner surface thereof ;

a resilient film received in the eyeball, the resilient film comprising a pupil portion and an iris portion surrounding the pupil portion, the pupil portion being a first color, the iris portion being a second color other than the first color;

a driving mechanism comprising an electromagnet and a magnetic body arranged between the electromagnet and a transmission mechanism, the driving mechanism providing a repellant force generated between the electromagnet and the magnetic body and an attractive force generated between the electromagnet and the magnetic body; and wherein the transmission mechanism is arranged between the electromagnet and the resilient film, the transmission mechanism comprising a plurality of transmission members, each transmission member being movably received in a corresponding guide arm, the transmission members being connected to the resilient film and capable of moving in the corresponding guide arms;

wherein when the repellant force is generated, the magnetic body moves the transmission members in the corresponding guiding arms to stretch the resilient film, such that the pupil portion is dilated; and when the attractive force is generated, the magnetic body moves the transmission members in the corresponding guiding arms to contract the resilient film, such that the pupil portion is contracted.

* * * * *